US008717240B2

(12) United States Patent
Flores-Cuadras et al.

(10) Patent No.: US 8,717,240 B2
(45) Date of Patent: May 6, 2014

(54) MULTI-ANGLE ULTRA WIDEBAND ANTENNA WITH SURFACE MOUNT TECHNOLOGY

(75) Inventors: Javier Ruben Flores-Cuadras, Los Mochis-Ahome (MX); Dermot O'Shea O'Shea, Enniscorthy (IE); Rónán Quinlan, Dublin (IE)

(73) Assignee: Taoglas Group Holdings, Wexford (IE)

( * ) Notice: Subject to any disclaimer, the term of this patent is extended or adjusted under 35 U.S.C. 154(b) by 572 days.

(21) Appl. No.: 12/566,199

(22) Filed: Sep. 24, 2009

(65) Prior Publication Data

US 2011/0068996 A1 Mar. 24, 2011

(51) Int. Cl.
*H01Q 1/24* (2006.01)
*H01Q 1/38* (2006.01)
*H01Q 1/20* (2006.01)

(52) U.S. Cl.
USPC ..... 343/702; 343/882

(58) Field of Classification Search
USPC ..... 343/702, 872, 873, 700 MS, 882; 455/575.7
See application file for complete search history.

(56) References Cited

U.S. PATENT DOCUMENTS

| | | | | |
|---|---|---|---|---|
| 4,441,498 | A * | 4/1984 | Nordling | 607/32 |
| 4,894,663 | A * | 1/1990 | Urbish et al. | 343/702 |
| 7,161,536 | B2 * | 1/2007 | Hilgers | 343/700 MS |
| 7,864,121 | B2 * | 1/2011 | Suprunov et al. | 343/702 |

* cited by examiner

*Primary Examiner* — Michael C Wimer
(74) *Attorney, Agent, or Firm* — Coastal Patent Law Group, P.C.

(57) ABSTRACT

A multi-angle ultra wide band antenna for electronic devices is disclosed. The said antenna cover all mobile bands world-wide: 700/850/900/1700/1800/1900 and 2100 MHz and with sufficient bandwidth to include the 2400 and 2500 MHz mainly used in wireless networks, having a radiated element supported by a first substrate and expanding into a spatial geometry for transmission and reception of radio signal. An antenna base has a plurality of first solder pads on a second substrate for physical attachment to a printed circuit board and a second solder pad electrically connected to a terminal of said antenna to radio circuitry feed point, with compatible surface mount technology. The first and second substrates are joined by a bending line as a single substrate, where the said first substrate is allowed to be bent relative to the plane of the said second substrate.

7 Claims, 6 Drawing Sheets

MULTI-ANGLE ULTRA WIDEBAND ANTENNA WITH SURFACE MOUNT TECHNOLOGY

FIELD OF THE INVENTION

The present invention relates in general to antennas, in particular to surface mount devices, and more particularly an antenna with a flexible body that can be bent on different angles and can be directly assembled to a printed circuit board by surface mount technique.

BACKGROUND OF THE INVENTION

Extensive efforts have been devoted to research and develop an antenna that can be used throughout the world, covering all the current cellular bands and complying with all communication standards, plus having the convenient surface mount technique for low cost and high reliability.

Cellular and mobile devices are now operating with quad-band antennas, these bands are the 850 (GSM), 900 (EGSM), 1800 (DCS) and 1900 MHz (PCS), but with the introduction of 3G and 4G technologies for higher speed and data transfer rate in cellular applications, three new bands are introduced in the radiofrequency spectrum, 700 (LTE), 1700 (UMTS) and the 2100 MHz (WCDMA), but not exclusive to these communication standards.

With the introduction of the new 700 MHz (LTE) band in North America, it is indeed higher complexity for its integration while keeping the antenna size similar to quad-band antenna, satisfying the current demands for small devices. Over the years is observed how the devices tend to be smaller, but with the new low frequency band presents a real challenge in miniaturization and the bandwidth must be increased to incorporate more new frequencies: 1710 and 2100 MHz bands. New technologies, materials, topologies, form factors and novel designs must be studied to continue miniaturizing the antennas and complains with the demands of the current and future market's needs.

The Basic formula for antenna design dictates that the length of the antenna is one-quarter of the wavelength at the desired frequency, 35 mm (one quarter of the wavelength in free space) is the physical length for a pure straight cable or, monopole antenna at 2100 MHz, contrasting with 108 mm of physical length for a basic monopole antenna at 700 MHz. Reducing the antenna at low frequencies present a real challenge, but some techniques are studied like increasing the dielectric constant of the material that enclose the antenna, bending the metallic radiated element and find the specific geometrical shape that reduce the space occupied by the antenna. The ratio of miniaturizing and antenna via higher dielectric constant is equal to $1/\sqrt{\in}$, where $\in$ is the dielectric constant of the material used as a carrier for the metallic path of the antenna.

The flexible material Kapton used on this antenna has a dielectric constant of 3.8. The total thickness of the flexible material is approximately 0.85 mm, enclosing the radiated elements. Using this flexible material for the antenna design presents propitious conditions to achieve two important phenomenons in the antenna design. The first one is enclosing the radiated elements with this Kapton material, reducing the size of the antenna even with a thin factor, due the currents of the electromagnetic fields are traveling in the surface of the radiated elements having an interaction with the high dielectric constant material, and at the same time the second condition, having the thin material with high dielectric constant supporting the radiated elements, is almost imperceptible in compare with the air that surrounds the antenna; this means the antenna is surrounded mainly by air, as a consequence resulting with an effective dielectric constant (computation the two materials with different dielectric constant) very close to the free-space.

Presenting the advantages of a complete surface mount technology integration, for an easy, cheap, time saving, and automated integration, eliminating the necessity of human interactions for soldering purposes, pogo pin and spring contacts. All of this assembling and integration qualities ends in delivering a reliable and consistence antenna performance, reflected on better signal reception, making the antenna feasibly for telematic, tracking, telemedicine, automotive, fleet management, vehicle diagnostics, remote monitoring and also in the emerging telemedical diagnostic market.

SUMMARY OF THE INVENTION

It is therefore an object of the present invention to provide an ultra wideband antenna to cover all the cellular bands worldwide, operating as hepta-band cellular antenna, enclosing the traditional quad-band cellular antenna and the three new bands.

It is another object of the present invention to provide an antenna with sufficient gain, efficiency, bandwidth and omni-directional properties to be used in other frequencies such as 2400 and 2500 MHz used in WiFi, WiMAX, ISM, ZigBee and emerging technologies in the frequencies from 1000 MHz to 1400 MHz and from 2700 MHz to 3100 MHz.

It is also an object of the present invention providing a multi-angle flexible antenna for electronic device comprising an antenna expand having the radiated elements supported by a first substrate and expanding into a spatial geometry for transmission and reception of radio signal; and an antenna base having a plurality of first solder pads on a second substrate for physical attachment to the printed circuit board and a second solder pad electrically connected to a terminal of said radiated elements for connection to an antenna feed point of a radio circuitry on said printed circuit board; wherein said first and second substrates are joined at a bending line as a single substrate for said flexible antenna and said first substrate allowed to be bent relative to the plane of said second substrate for spatial deployment of said radiated elements.

It is yet another object of the present invention to provide an antenna with a flexible body, where the said first substrate can be bent at different angles from −90 to +90 degrees with respect of the said second substrate.

The present invention achieves the above and other objects by providing a flexible antenna for electronic devices, that can simplify the assembling process in the antenna integration, incorporating the surface mount device technology in the antenna structure to a printed circuit board on said second substrate of the antenna onto said printed circuit board, having a plurality of first solder for physical attachment and a second solder pad electrically connected onto said printed circuit board for the radio signal propagation. The flexible material is not deformed by the high temperatures in the surface mount process and/or not suffering any kind of shrinking effect in the substrate.

A stiffer has been incorporated to assist a successful surface mounting assembly procedure of the antenna to the device, it can be made by any Flame Retardant 4 (FR-4) material or the UL-94-V0 standard polyimide attaching it to the antenna with a very fine glue. This glue can afford the high temperature for the SMD process. This stiffer can be easily removed after the surface mount process when is concluded without leave any residue. Due the light in weight of the antenna could not be accurate to stay on its placed location on the device and/or too thin in thickness to maintain its proper structural shape during the entire procedure as consequence from violent pick-and-place movements for all components of the device-board. Usefulness of such as stiffer is to provide overall structural rigidity and add weight to the flexible antenna to maintain the placement in the SMD production, having an extra in weight pressing down the antenna and having a better contact, avoiding inaccurate soldering.

In summary, the low profile flexible antenna in accordance with the present invention based essentially on the proven flexible circuit technology is particularly useful in mobile applications such as for consumer electronic devices, having a unique characteristic where in one structure high performance, surface mountable and having different bending angles to conform different shapes are achieved, ending in easy, practical, cheap and time saving at the integration. Automated integration becomes possible avoiding labors such as soldering and installation of pogo pin and spring contacts, resulting in a reliable and consistence antenna performance and the present invention can be delivered on tapes and reels just like SMD diodes, resistors and others.

BRIEF DESCRIPTION OF THE DRAWINGS

FIG. 9 3D Radiation Pattern Graph at 850 MHz.

FIG. 10 3D Radiation Pattern Graph at 1900 MHz.

FIG. 11 3D Radiation Pattern Graph at 2400 MHz.

DETAILED DESCRIPTION OF THE INVENTION

The present invention is described in more detail with reference to the accompanying drawings, which should not be construed as limiting the embodying of the antenna of the present invention set forth therein.

Figure 1:
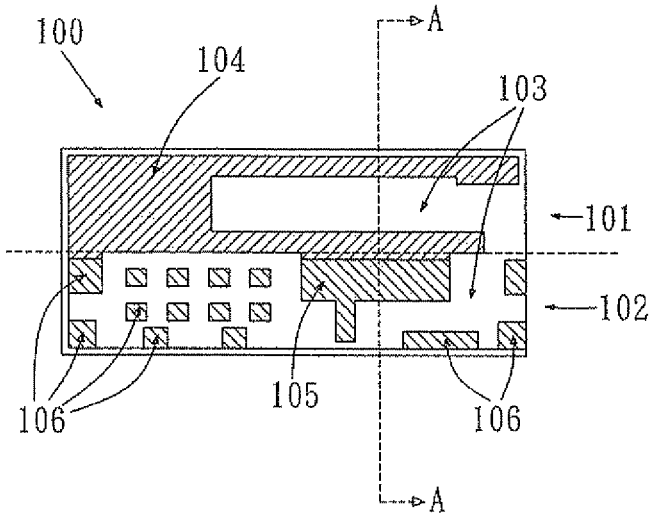
FIG. 1 Plan view of the Multi-Angle Ultra Wideband Antenna with Surface Mount Technology.

In a preferred embodiment of the present invention, a flexible antenna is essentially an electrical component much like a multi-lead IC or other surface mountable electronic components and is treated like one. FIG. 1 illustrates the ultra wide band antenna with no cable required for signal radio propagation in accordance with a preferred embodiment of the present invention.

A flexible antenna 100 of the present invention has a copper layer 104 patterned into the desired shape and geometry in the bottom side, the side of the antenna component 100 that faces toward the printed circuit board when it is assembled. This metallic pattern with its specific spatial geometry is typically shaped from half-ounce copper layer adhered to a substrate. Literally this copper layer 104 is "held" in its fixed shape and place by any suitable thin insulator substrate 103.

As is illustrated in the FIG. 1 the ultra wideband antenna 100 of the present invention can be divided into two portions by a bending line (shown as phantom line in the drawing), i.e., an antenna expand 101 and an antenna base 102. The first portion, the antenna expand 101, is the true expansion of the flexible antenna conductor with its designed shape and spatial geometry. This portion of the flexible antenna 100 of the present invention is allowed to bend away from the plane of the antenna base 102, permitting any adjustment of the antenna conductor deployment relative to the main board or PCB of the electronic device that the antenna serves from −90 to 90 degrees.

Antenna base 102 is used for both the physical and electrical connection of the entire antenna 100 to the PCB, on which it is to be assembled using surface mount technique. As illustrated, several solder pads 106 are made on the bottom side of the antenna. These pads serve to physically attach the entire antenna to its host printed circuit board when assembled in a surface mounting procedure. Another solder pad 105, which is electrically connected to the lead terminal of the copper antenna, serves to electrically connect the antenna to the corresponding antenna feed point of the radio circuitry located on the printed circuit board, both pads who serves to physically attached the antenna and to electrically connect it, are gold plated to avoid oxidation after production, having a clean and reliable mounting procedure once the antenna is fixed to its host printed circuit board.

Thus, while the antenna copper and the pads are seen formed on the bottom side of the flexible antenna 100, they are still visible through the partially opaque Kapton substrate 103 from the top side, as is illustrated in FIG. 1.

The antenna shown in FIG. 1 can be dimensionally configurable changing the angle of the said first substrate and surface mountable UWB (ultra wide band) antenna for consumer electronics. Radiating element of the UWB antenna, the copper 104, which may be adhered to the flexible material 103, has a designed spatial geometry for optimized performance in the UWB category of antennas. As is well known in the art, spatial geometry of the shape of this radiator element 104 has complete control over antenna resonance and performance. Once optimized for a design, change in the form and shape of the copper pattern may sometimes be necessary for fine-tuning. In this case, the low cost and flexible antenna 100 of the present invention can be redesigned and replaced with ease.

Figure 2:
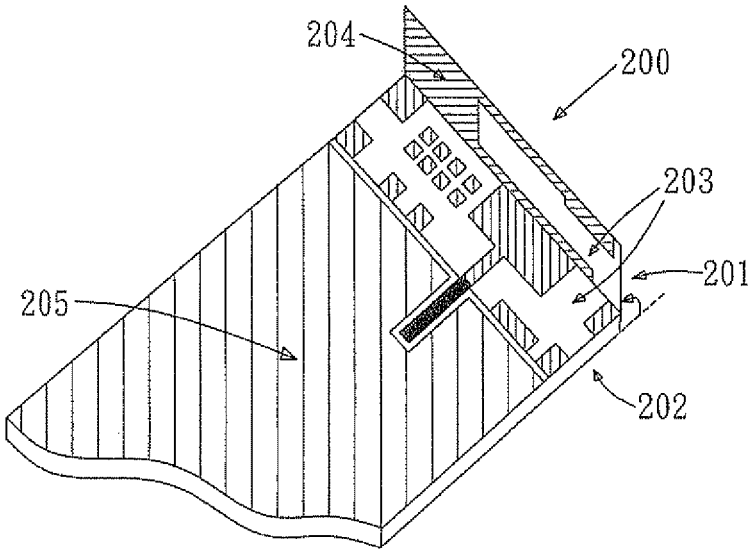
FIG. 2 Illustration of the present invention showing a +90 degrees position on the evaluation board.

FIG. 2 is a perspective view of a flexible antenna 200 with an up-bending of its antenna expand 201 relative to its antenna base 202. If necessary, antenna expand 201 of the antenna 200 can be configured into different bending angles with respect to the plane of the circuit board 205, in a wide range from nearly −90 to nearly +90 degrees. This permits spatial adjustment of the deployment of the antenna conductor relative to the main board of the electronic device that the antenna serves. Such bending can be facilitated either before or after the antenna's assembly to the host printed circuit board. Note that the implementation of the ultra wideband antenna of the present invention depicted in FIG. 2 incorporates the use of an additional stiffer 306, during the surface mount procedure and easily removed after attaching the antenna to its host PCB, to be explained in the following paragraphs.

This is particularly the case in small and thin flexible antennas that may be too light in weight to stay on its placed location on the PCB and/or too thin in thickness to maintain its proper structural shape during the entire procedure of violent pick-and-place movements for all components of the PCB. Usefulness of such a stiffer is to both provide overall structural rigidity and add weight to the flexible antenna so that antenna placement in the SMT production stage may enjoy good positioning accuracy.

Figure 3:
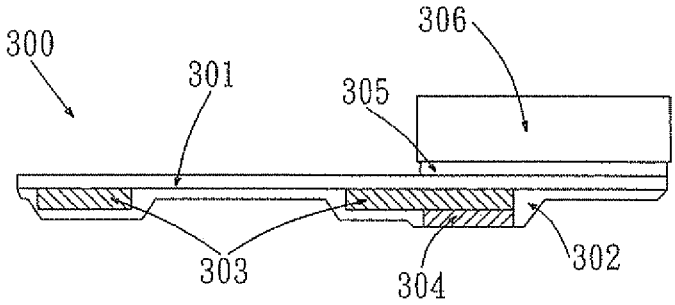
FIG. 3 Sectional view to describe the different layers in the flexible antenna.

FIG. 3 is the cross-sectional view of ultra wideband antenna of the present invention taken along the A-A line. The stiffer in FIG. 1 as is illustrated, which can be made of Flame Retardant 4 (FR-4) material to the UL-94-V0 standard, can be attached to the top surface of the antenna base 202 of the flexible antenna 200 via convenient method, for example the use of a layer of adhesive 305, to peel off of the stiffer after the antenna assembly in an IR reflow procedure reduces both size and weight of the finished electronics product Also, as is well known in the art, a layer of solder mask 302 is typically used to protect the copper 303 of the antenna. Note that the dimensions of thickness of each layer in this drawing are not drawn to the exact scale.

Figure 4:
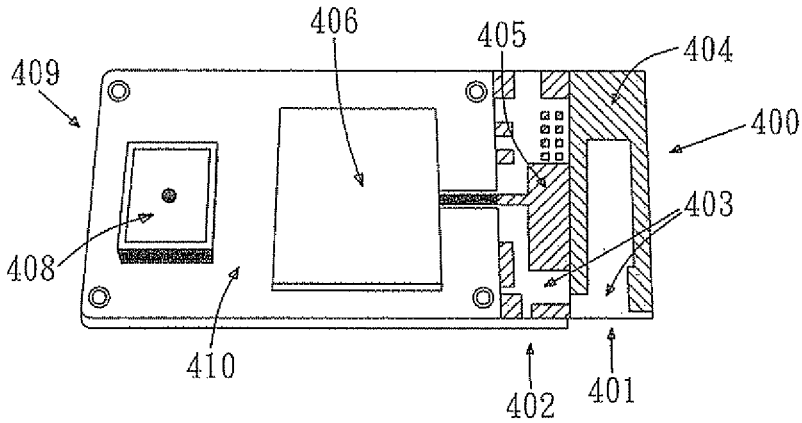
FIG. 4 Perspective view with 0 degrees position on a typical automobile vehicle locator device.
Figure 5:
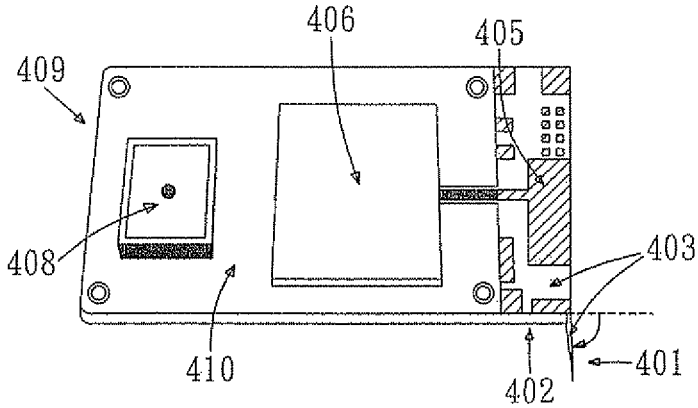
FIG. 5 Perspective view with −90 degrees position on a typical automobile vehicle locator device.

FIGS. 4 and 5 illustrate a typical AVL (automatic vehicle locator) that incorporates the flexible ultra wide band antenna 400 of the present invention. An AVL has UPS 408 and GSM antenna. To achieve best possible isolation and eliminate mutual coupling, its UPS antenna 408 typically needs to be placed as far away from GSM as possible. Antenna used for the GSM system in the AVL is the flexible antenna in accordance with a preferred embodiment of the present invention while the GPS antenna 408, which can be a ceramic type for such as application.

As is illustrated in FIGS. 4 and 5, the GSM antenna 400 is settled in 0 and −90 degrees configuration relative to the plane of the circuit board 408 respectively. The radiating element, the copper 404, of the antenna 400 is essentially in "free space" because it extends beyond the end of the host printed circuit board 408. This means there is no obscure against its performance. Such a bend is possible for antenna of this invention that requires such physical arrangement to save space or for other mechanical or electromagnetic considerations.

Figure 6:
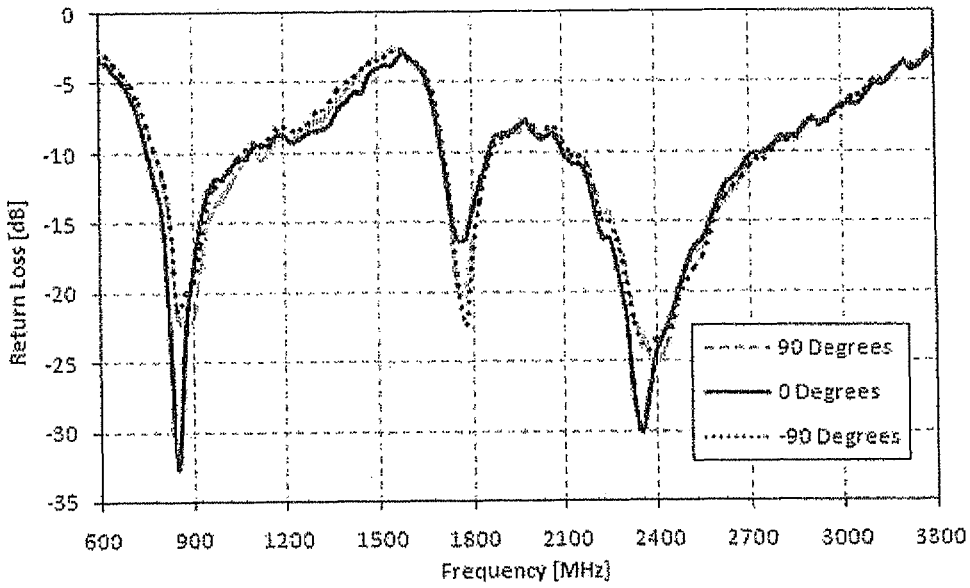
FIG. 6 Return Loss Graph.

FIG. 6 shows the return loss characteristic of an antenna of the present invention. The antenna tested has a radiating element with spatial geometry that is shown in FIG. 1. The full spectrum reflection coefficient of the antenna is shown in terms of signal magnitude. It is clearly observable that the antenna has three resonances, one at the lower frequency and two at higher frequencies.

Typical bandwidth definition calls for a return loss of below −5 dB (equivalent to a VSWR of 3.5). Such return loss reflects how much power is transferred from the radio circuitry to the antenna. Low end of the antenna frequency bandwidth is approximately in the range of from 700 to 1400 MHz, and the percentage of the bandwidth at this lower frequency is 70%, said lower frequency at 850 MHz. On the other hand, for the high end of the bandwidth, the frequency is from roughly 1675 to 3100 MHz, and the percentage of the bandwidth at the higher frequency is 60%, said the higher frequency at 1900 MHz. The percent of bandwidth for the whole antenna spectrum based in the 3 resonances and below −5 dB is 86% from 700 to 3100 MHz.

The antenna measured in FIG. 1 was tested on an evaluation circuit board, with its radiating portion positioned in three different angles (boundary conditions). The test results show that angling places no effect on the antenna performance, proving the feasibility of the antenna of the present invention in applications of differently angled positions.

The wider bandwidth the antennas of the present invention achieve is capable of covering all frequencies for present-day communication technologies that include the cellular and ISM bands such as 700, 850, 900, 1700, 1800, 1900, 2100, 2400 and 2500 MHz and other frequencies that can be used in up-coming technologies in the antenna spectrum from 700 to 1400 MHz and 1675 to 3100 MHz. In other words, the antenna of the present invention has the right characteristic for an ultra wide band antenna, with a total bandwidth of 86%.

Figure 7:
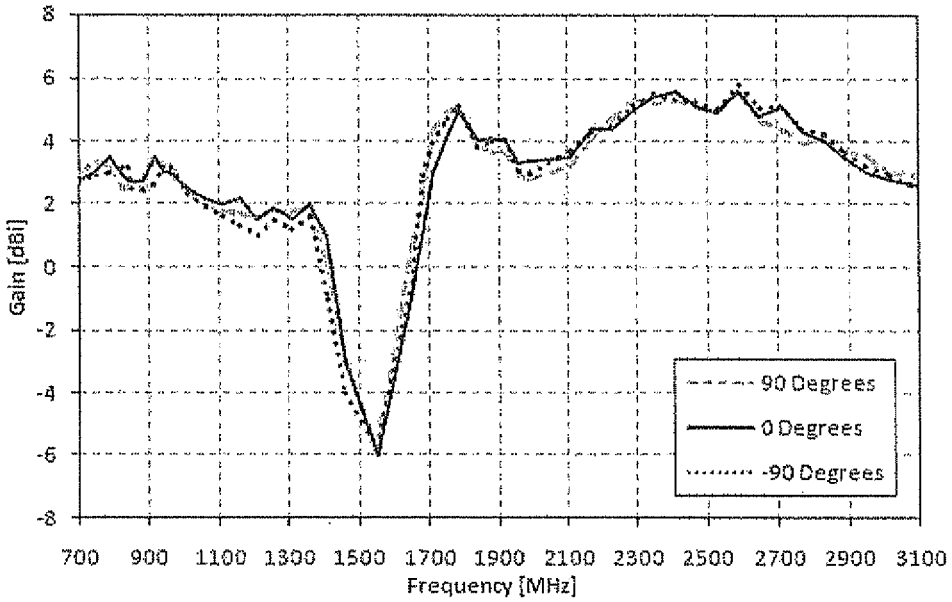
FIG. 7 Gain Graph.

FIG. 7 shows the gain characteristic measured in dBi of an antenna of the present invention that is at maximum angles in three dimensional test scanning. The antenna was tested in three different positions of the first substrate in −90, 0 and +90 degrees in an echoic chamber equipped with a 3D scan system. The antenna tested exhibits high correlation among its three different positions. The gain at lower frequencies varies from 1.8 to 3.8 dBi for the three positions and the gain at the higher frequencies is from 2.5 to 6 dBi. As can be seen from the gain characteristic curve, the antenna performed extremely well. The antenna exhibits high performance along the whole antenna spectrum.

Figure 8:
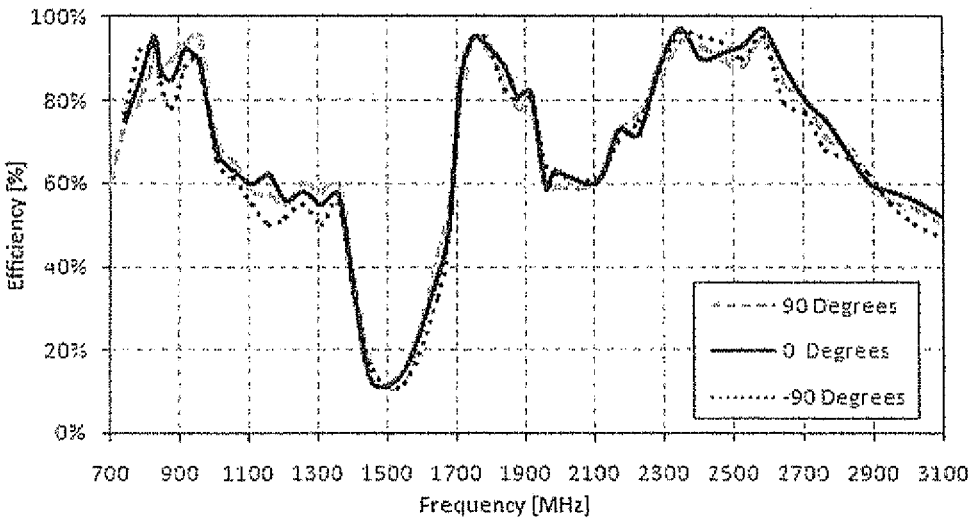
FIG. 8 Radiation Efficiency Graph.

One of the most important parameters to qualify an antenna performance is the efficiency. The efficiency characteristic shown in FIG. 8 is relates to how much energy can be conveyed from antenna to free space. In other words, this efficiency represents the real energy conversion performance of an antenna measured in percentage. The inventive antenna tested exhibits high percentage value across its entire operating spectrum. For the cellular bands the efficiency is above 60% across the entire bandwidth. 50% efficiency means that half of the electrical power delivered from the radio circuitry is radiated into the space as signal. For the main 850 and 1900 MHz cellular bands in the United States, the antenna tested achieved over 80% efficiency.

Figure 9:
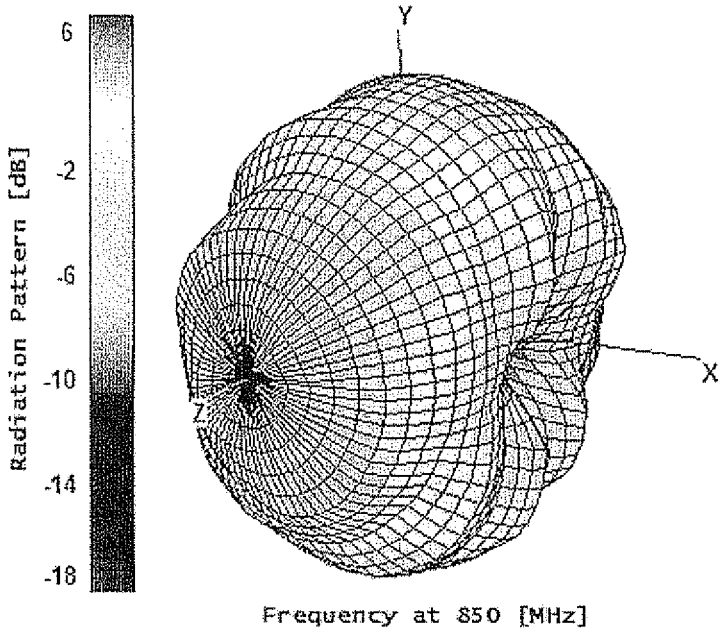
Figure 10:
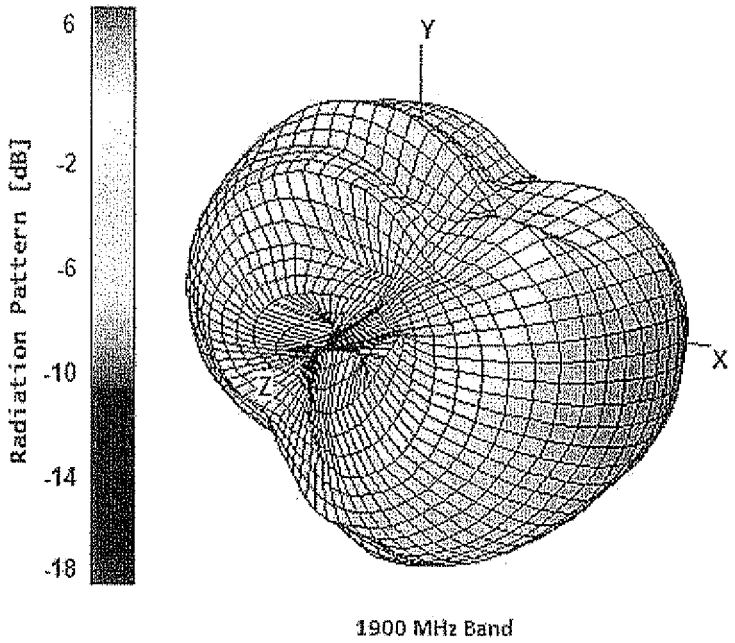
Figure 11:
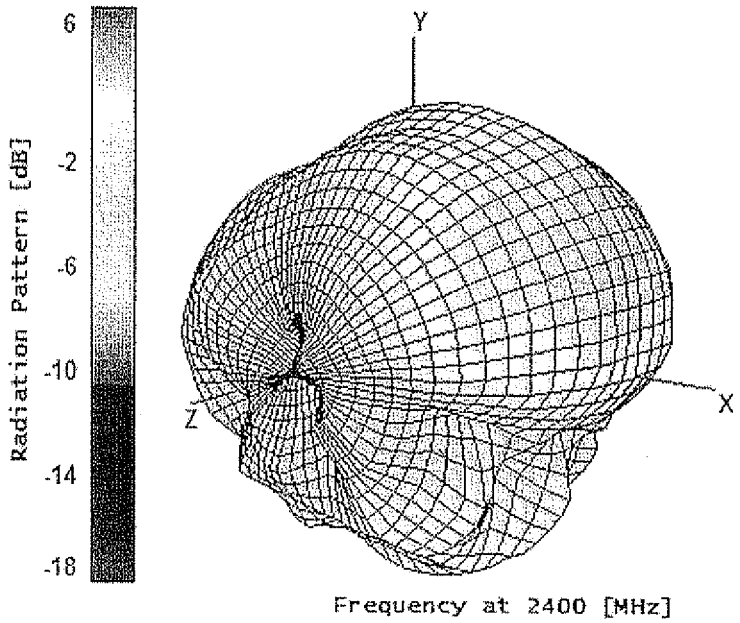

For radiation pattern only three representative frequencies at 850, 1900 and 2400 MHz were selected and tested on prototype antenna of the present invention, the test results as described above reveal the fact that the inventive antenna of the present invention has omni-directional properties. For example, the 850 MHz radiation pattern shown in FIG. 9 exhibits an almost perfect characteristic for an omni-directional antenna. FIGS. 10 and 11 show the radiation pattern of an inventive antenna of the present invention tested at 1900 and 2400 MHz respectively. In these two tested cases the radiation pattern each presents an omni-directional characteristic that is a little asymmetric as consequence of higher frequencies.

In summary, the low profile flexible antenna in accordance with the present invention based essentially on the proven flexible circuit technology is particularly useful in small size antenna applications such as for consumer electronic devices. Cell phones, PDA and other consumer electronics equipped with such an innovative flexible antenna of the present invention can enjoy very good antenna efficiency in tests conducted on prototypes, antenna efficiencies of more than 50% for all bands have been observed.

In a monopole application, the flexible antenna of the present invention can be coupled to the ground plane of the main board to have improved radiation characteristics. This leads to improved device performance in areas of signal strength, sensitivity, data throughput and reliability. The surface mountable flexible antenna of the present invention is therefore a low cost yet good performance alternative to existing antenna technologies, which require a costly cable and connector.

The surface mountable flexible antenna of the present invention can be designed to work in one band or multiple bands across a range of frequencies. It can be used in all radio frequency applications in cellular, ISM bands and others.

While the above is a full description of the specific embodiments, various design modifications, alternative constructions and equivalents may be used. Therefore, the above description and illustrations should not be taken as limiting the scope of the present invention.

What is claimed is:

1. A flexible ultra-wideband antenna assembly adapted for surface-mount attachment with a circuit board, the antenna assembly comprising:

a flexible substrate having a first portion and a second portion formed about a bending line extending longitudinally therebetween, the flexible substrate having a top side and a bottom side opposite of the top side;

said first portion comprising an antenna conductor disposed on the bottom side of the substrate, the antenna conductor comprising a pattern designed for wide band operation, wherein the antenna conductor being disposed on the flexible substrate is adapted for bendable adjustment about the bending line for optimizing antenna performance;

said second portion comprising a plurality of first solder pads and a second solder pad, the first solder pads being configured to attach the antenna to the circuit board, the second solder pad being electrically connected to a terminal of said antenna conductor and adapted for connection to an antenna feed point of the radio circuit on the circuit board;

said first and second solder pads each being disposed on the bottom side of the substrate and within the second portion; and a stiffener being removeably adhered to the top side of the substrate, the stiffener configured to span at least an area of the second portion of the substrate such that the second portion of the substrate is disposed between the stiffener and the first and second solder pads when the stiffener is adhered, the stiffener providing rigidity and weight for achieving optimal surface-mounting attachment and reduced deformation of the substrate, and the stiffener being adapted to be removed from the substrate after surface-mounting;

wherein said first and second portions of said substrate are joined at a bending line and said first portion is adapted for bendable configuration about said second portion at said bending line for bendable configuration of the antenna conductor about the circuit board;

wherein said flexible substrate and said first and second solder pads thereon are each adapted for attachment with the circuit board upon application of heat in a surface-mounting process; and wherein said flexible substrate is further adapted to maintain structural integrity in the presence of said heat such that the flexible antenna is capable of surface-mount attachment with the circuit board.

2. The flexible antenna assembly of claim 1 wherein said antenna conductor comprises a copper layer adhered to the surface of said first portion.

3. The flexible antenna assembly of claim 1 wherein said substrate comprises a polyimide film.

4. The flexible antenna assembly of claim 3, wherein said polyimide film is at least partially transparent for visually aligning said solder pads about the circuit board for surface mounting thereon.

5. The flexible antenna assembly of claim 3, wherein said polyimide film is adapted to maintain structural integrity under said application of heat during surface mounting.

6. A flexible ultra-wideband antenna assembly adapted for attachment with a printed circuit board using a surface-mounting process, comprising:

a polyimide substrate having a first portion and a second portion extending across a planar surface thereof;

said first portion being joined with said second portion at a bending line;

said first portion comprising an antenna conductor disposed on a bottom surface of the first portion;

said second portion comprising a plurality of first solder pads for attachment of the second portion with the printed circuit board, and a second solder pad for attachment with a feed line connection of a radio circuit, the first and second solder pads each being disposed on a bottom surface of the second portion; and a stiffener being removably adhered to a top surface of the second portion by an adhesive layer, the top surface being opposite of the bottom surface, the stiffener spanning an area of the second portion and configured to be disposed above the substrate with the first and second solder pads placed against the printed circuit board, the stiffener being configured to provide rigidity and additional weight for optimizing surface-mounting attachment of the antenna with the printed circuit board;

wherein said first portion is adapted for flexible configuration about said second portion at said bending line; and wherein said polyimide substrate is adapted to maintain structural integrity upon application of heat for surface mount attachment of the antenna with said printed circuit board.

7. An antenna assembly for attaching an antenna with a printed circuit board using a surface-mounting process, the antenna assembly comprising:

a flexible substrate sheet spanning an area defined by a first portion and a second portion, the first portion and second portion being joined at a bending line extending longitudinally along a length of the substrate, the substrate sheet having a top side and a bottom side opposite of the top side;

an antenna conductor coupled to the first portion of the substrate on the bottom side;

a plurality of first solder pads for attaching the antenna and first portion of the substrate to the printed circuit board, the first solder pads being disposed on the second portion of the substrate and on the bottom side thereof;

a second solder pad adapted to couple with an antenna feed point of a connected radio circuit, the second solder pad being disposed on the second portion of the substrate and on the bottom side thereof, the second solder pad being connected to the antenna conductor along a portion of the bending line; and a stiffener being removeably attached to the top side of the substrate by an adhesive layer disposed therebetween, the stiffener configured to span an area of the second portion and further configured to provide rigidity and weight for optimizing surface-mounting attachment of the antenna with the printed circuit board and reducing deformation of the substrate;

wherein said antenna disposed on the first portion is adapted for flexible configuration about said second portion at said bending line; and wherein said substrate with the attached stiffener is adapted to maintain structural integrity upon application of heat for surface mount attachment of the antenna with the printed circuit board.

* * * * *